US006033314A

United States Patent [19]

Coccomo

[11] Patent Number: 6,033,314

[45] Date of Patent: Mar. 7, 2000

[54] BOWLER'S ACCESSORY HAVING A CHALK ELEMENT DISPOSED WITHIN A HOLDER

[76] Inventor: Mike Coccomo, 1721 NW. 15th St. Vista, Apt. #3, Boca Raton, Fla. 33432

[21] Appl. No.: 09/249,079

[22] Filed: Feb. 10, 1999

Related U.S. Application Data

[60] Provisional application No. 60/087,590, Jun. 1, 1998.

[51] Int. Cl.[7] ..... A63D 5/00

[52] U.S. Cl. ..... 473/54; 473/35; 473/36

[58] Field of Search ..... 473/35, 36, 54

[56] References Cited

U.S. PATENT DOCUMENTS

| | | | |
|---|---|---|---|
| 133,603 | 12/1872 | Thomas . | |
| 561,659 | 6/1896 | Currier . | |
| 3,843,120 | 10/1974 | Ricci . | |
| 5,129,187 | 7/1992 | Cain . | |
| 5,338,261 | 8/1994 | Stegman . | |
| 5,477,620 | 12/1995 | Barnett . | |
| 5,545,093 | 8/1996 | Contestabile et al. | 473/36 |

*Primary Examiner*—William M. Pierce

*Attorney, Agent, or Firm*—National Patent Services; Tom Hamill, Jr.

[57] ABSTRACT

A bowler's accessory comprising a chalk element disposed within a chalk holder with cap ends is provided. The chalk holder includes a cylindrical tube having a wall, a top opening and a bottom opening. Cap elements are designed to slidingly interfit into the top opening and the bottom opening. The chalk element further has a top side and a bottom side. The chalk element is positioned near the middle of the tube, with the top side and the bottom side of the chalk element being about equal distance to the top opening of the tube and the bottom opening of the tube. The chalk element may be press fitted, adhered to, or in some other fashion affixed to this location within the cylindrical tube. The distance from both the top side of the cylindrical tube and the bottom side of the cylindrical tube is sufficient to permit the cap elements to slidingly interfit in both the top opening and the bottom opening of the cylindrical tube. The chalk element further has an aperture passing through about the center of the chalk element from the top side to the bottom side. This configuration permits fingers or other objects to be placed inside the tube, and further inside the chalk element's aperture, where they are to be coated with chalk. This permits the bowler to have greater control over the release of the bowling ball during the game.

4 Claims, 2 Drawing Sheets

Fig. 2
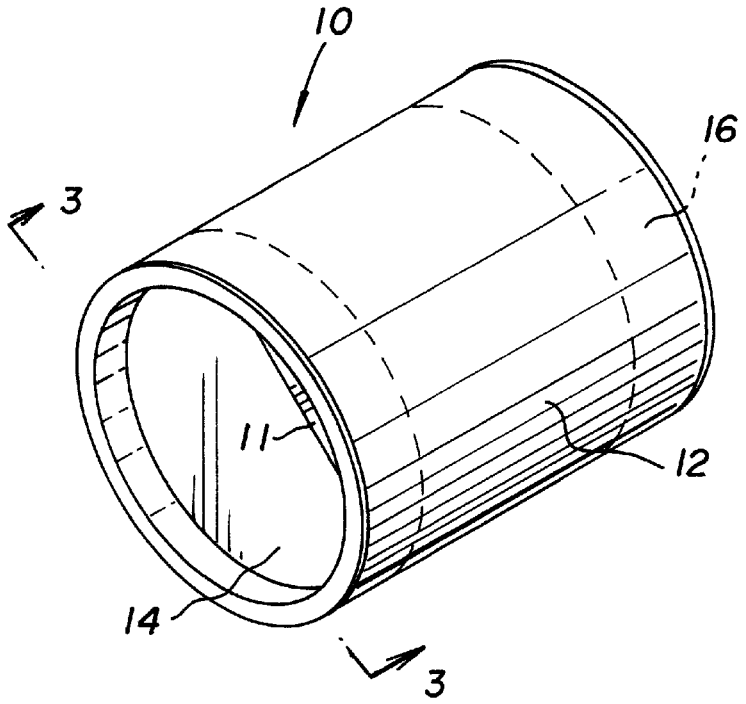
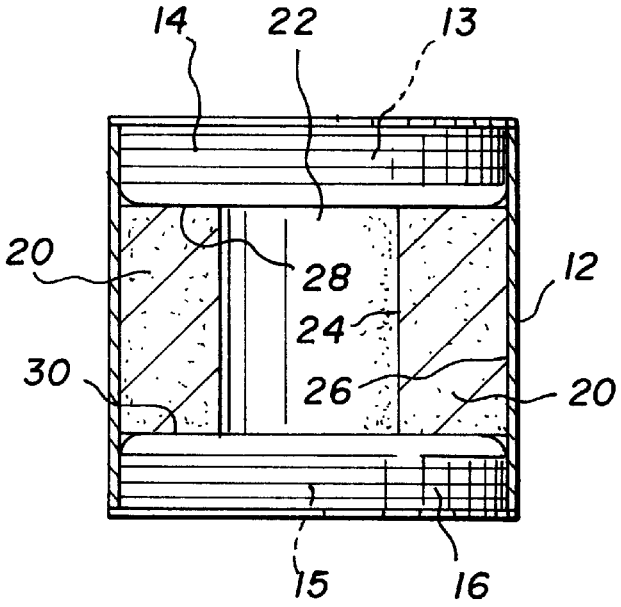
Fig. 3
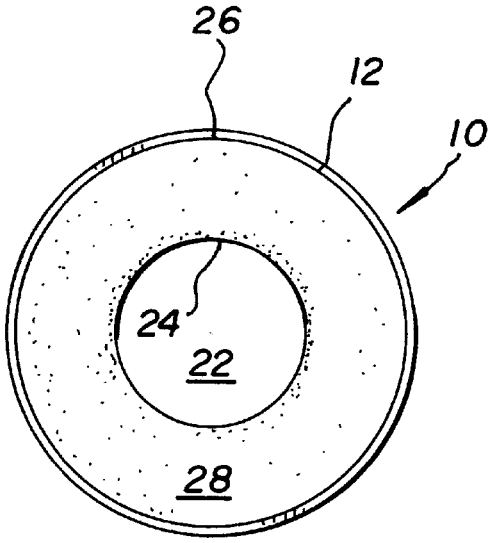
Fig. 4

BOWLER'S ACCESSORY HAVING A CHALK ELEMENT DISPOSED WITHIN A HOLDER

This application claims the benefit of provisional application No. 60/087,590 filed on June 1, 1998.

BACKGROUND OF THE INVENTION

1. Field of the Invention

The present invention relates generally to devices for retaining coating materials, and more particularly, to a chalk holder with end caps designed to permit digits of the human hand to be coated with the chalk.

2. Description of the Prior Art

Devices for retaining chalk or other coatings for a myriad of purposes are known in the art. They include the following U.S. Pat. Nos.

5,545,093
5,129,187
0,561,659
0,133,603

In the sport of bowling, the player inserts their fingers into a plurality of holes which penetrate into the bowl, and swing the bowl, releasing it in order to permit it to roll down a lane and strike down the pins. Perspiration and other wetting agents may form on the fingers of the user, resulting in loss of control during the swing and release phase of the game. Chalk cones have been used in the past in order to permit one to 'chalk up' prior to playing. These cones do not have a holder, nor are they any longer in popular use.

Chalk is generally considered to be a soft, white, powdery substance consisting chiefly of fossil shells of foraminifers. It may, for this application, also be considered to be other soft, water absorbing agents. When used in this application, the term chalk is not considered to be limiting to any particular composition, it is considered to be any material with properties which lend themselves to being employed in the manner depicted herein. Any composition which may be formed into the configuration describes, that may be rubbed onto the digits of a finger, and absorb water may be considered, for the claims of this application, to be chalk.

Thus, while the foregoing body of prior art indicates it to be well known to use a variety of devices to hold and retain chalk for coating devices, none of the devices teach or describe the simple structural configuration of the instant holder, nor do they describe the configuration of the chalk retained therein. The instant invention is superior over the prior art as it is a simple and cost effective device which may be easily utilized by a bowler or other person desiring to coat their thumb or fingers with a layer of chalk. Other advantages of the present invention over the prior art also will be rendered evident during this application.

SUMMARY OF THE INVENTION

To achieve the foregoing and other advantages, the present invention, briefly described, provides a bowler's accessory including a chalk element disposed within a holder which may include cap ends. The holder may be a cylindrical tube including a wall, a top opening and a bottom opening. A top and bottom cap elements are provided which are designed to slidingly interfit into the top opening and the bottom opening respectively. The chalk element is centrally disposed within the tube. The chalk element further has a top side and a bottom side. The chalk element is positioned near the middle of the tube, with the top side and the bottom side of the chalk element being about equal distance to the top opening of the tube and the bottom opening of the tube. The chalk element may be press fitted, adhered to, molded into, or in some other fashion affixed to this location within the cylindrical tube. The distance from both the top side of the cylindrical tube and the bottom side of the cylindrical tube is sufficient to permit the cap elements to slidingly interfit in both the top opening and the bottom opening of the cylindrical tube without coming into direct contact with the chalk element. The chalk element further has an aperture passing through about the center of the chalk element from the top side to the bottom side. This configuration permits fingers or other objects to be placed inside the tube, and further inside the chalk element's aperture, where they are to be coated with chalk.

In a preferred embodiment, the cylindrical tube may be a 2" long mailing tube having a diameter of 2", the diameter accomodating end caps. The chalk element may be about 1" from the top side to the bottom side and will be located within the tube with ½ inch remaining between the top opening of the tube and the top side of the chalk and ½ inch remaining between the bottom opening of the tube and the bottom side of the chalk. The aperture passing through the chalk element is designed to be about 1" in diameter. This provides a cylindrical ring of chalk with about a 1" aperture in the center and a 1" thick sidewall being centrally disposed within the cylindrical tube. A person will remove one of the end caps, place their thumb or finger within the chalk aperture, and coat the finger or thumb with a layer of chalk.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a chalk element with an aperture centrally disposed therethrough, the chalk element adapted to coat the fingers of a bowler prior to their insertion into the finger holes of the bowling bowl.

It is therefore an object of the present invention to provide a chalk holder which includes a hollow chalk retaining tube, the tube being made from plastic, cardboard or another material with similar mechanical properties.

It is therefore an object of the present invention to provide a chalk holder which includes a pair of end caps which will cover the first and second openings of the tube.

Another object of the present invention to provide a chalk holder which will retain a chalk element approximately at the midpoint of the tube, permitting the end caps to cover the openings without coming into contact with the chalk element.

Another object of the present invention to provide a chalk holder which includes a chalk element with a ring configuration, including a central aperture radiating from the center, the chalk beginning at a first inner wall, and the chalk terminating at an outer wall.

It is another object of the present invention to provide a chalk holder which may be easily and efficiently manufactured and marketed.

It is a further objective of the present invention to provide a chalk holder which is of durable and reliable construction.

An even further object of the present invention is to provide a chalk holder which is susceptible of a low cost of manufacture with regard to both materials and labor, and which accordingly is then susceptible of low prices of sale to the consuming public, thereby making such a chalk holder available to the buying public.

The chalk may be obtained in a generally powdered form, mixed with a non-toxic glue and press fit and molded into the tube hydraulically. Other means of placing the chalk element into the center of the tube, the chalk element having an aperture, include air injection, other injection processes as well as pre-molding the chalk and mechanically or manually inter-fitting the chalk element into the tube.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 2 is a perspective view of the chalk holder, with both bottom and top lids attached.

FIG. 3 is a cross-sectional side view of the chalk holder taken along line 3—3 of FIG. 2.

FIG. 4 is a top view of the chalk holder seen from arrow 4 of FIG. 1.

DESCRIPTION OF THE PREFERRED EMBODIMENT

Figure 1:
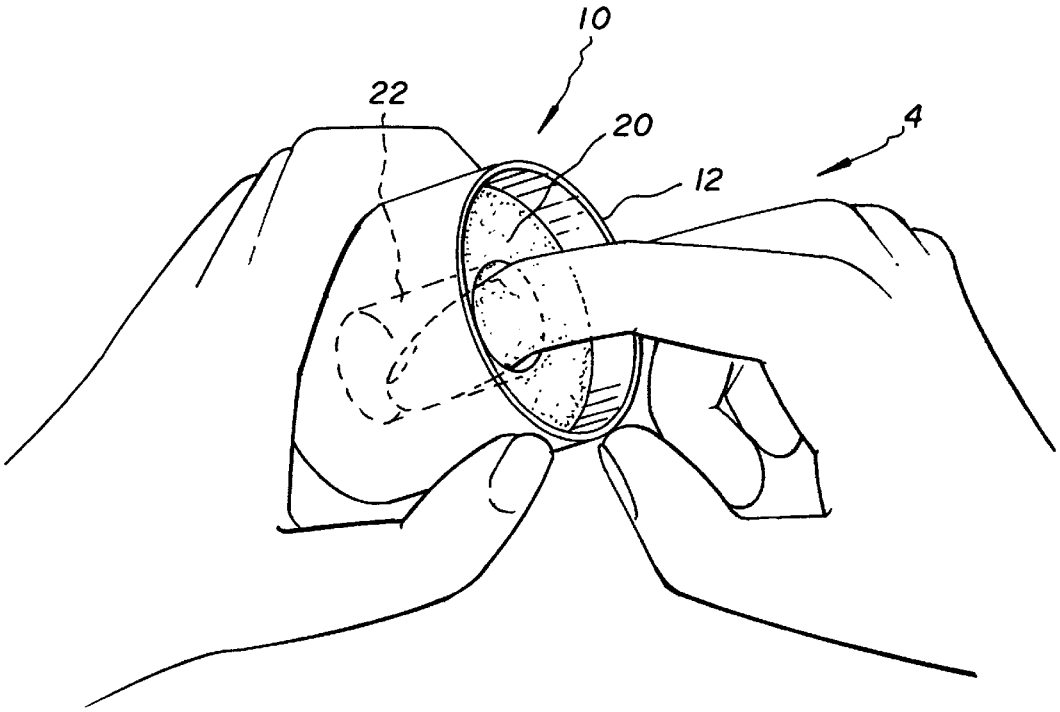
FIG. 1 is an environmental perspective view showing the chalk holder.

With reference now to the drawings, a new and improved chalk holder with cap ends embodying the principles and concepts of the present invention will be described.

Turning initially to FIGS. 1 & 2, the chalk holder with cap ends is designated by reference numeral 10. In its preferred form, the chalk holder 10 comprises a generally cylindrical tube 12 and has a top end cap or cover 14 and a bottom end cap or cover 16. The caps (14,16) are of a lesser diameter than the tube diameter and fit inside the tube 12 in a friction style arrangement. The caps (14, 16) may include a tab element 11 on their exterior surface to facilitate removal. The tube 12 may be constructed of cardboard, plastic, or any other suitable material with appropriate mechanical properties. Both end caps are designed to be comprised of plastic, however, it is envisioned that other materials may be utilized.

Referring now to FIG. 3, a cross sectional view of the chalk holder 10 taken along line 3—3 of FIG. 2 is shown. Chalk element 20 is shown generally centrally disposed within tube 12. Chalk element 20 has a central aperture 22 which passed through along the z-axis. This gives chalk element 20 an inner wall 24, an outer wall 26, an upper wall 28 and a bottom wall 30. Preferred dimensions have been previously discussed, however, those dimensions are not deemed to be limiting. Note how the tube has an upper opening 13 which the top end cap 14 is placed within and a bottom opening 15 in which the bottom end cap 16 is placed within. These openings are dimensioned appropriately to receive the top and bottom end caps in a friction fit arrangement. It is to be understood that other covering elements may be employed and other cap members are considered as being part of the instant invention. They include, but are not limited to, crimped caps, lids with mating structure on the tube, and caps which overlap the outside sidewall of the tube.

The chalk element 20 is generally cylindrical and has a generally cylindrical aperture 22 centrally disposed therethrough. The chalk element 20 is designed to be received in the tube 12; however, it is envisioned that the chalk element 20 may stand alone, sans tube. The tube 12 is useful for mailing and sales, however, the chalk element 20 may be employed without said tube.

FIG. 4 is a top view of the chalk holder 10. Chalk element 20 forms a ring type structure within tube 12. The upper wall 28, inner wall 24 and outer wall 26 are clearly shown. Aperture 22 will receive a finger or thumb within it, thus permitting the user to coat the digit with the chalk.

It is apparent from the above that the present invention accomplishes all of the objectives set forth by providing a chalk holder which includes a chalk element with a ring configuration, including a central aperture radiating from the center, the chalk beginning at a first inner wall, and the chalk terminating at an outer wall, the chalk element being retained in a generally cylindrical tube, permitting the user to coat a finger with a layer of chalk.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

I claim:

1. A bowler's accessory for holding chalk including:

a cylindrical element having a top opening and a bottom opening, a chalk element, said chalk element having a central aperture therein, said chalk element disposed within said cylindrical element, a top cap, said top cap removably affixed to said top opening, a bottom cap,said bottom cap removably affixed to said bottom opening, said chalk holder adapted to have a bowler insert the fingers of the hand therein, causing the fingers to be coated with chalk prior to their insertion into the bowling bowl.

2. A bowler's accessory as claimed in claim 1 wherein said chalk element includes a top portion and a bottom portion.

3. A bowler's accessory as claimed in claim 2 wherein said top cap is further slidingly received within said top opening, residing proximal said chalk opening top portion.

4. A bowler's accessory as claimed in claim 2 wherein said bottom cap is further slidingly received within said bottom opening, residing proximal said chalk opening bottom portion.

* * * * *